United States Patent [19]

Thornber et al.

[11] 3,969,454

[45] July 13, 1976

[54] METHOD OF MAKING COLORED PARTICLEBOARD

[75] Inventors: William Thornber; Brian Wrangham, both of Ottawa, Canada

[73] Assignee: Canadian Patents and Development Limited, Ottawa, Canada

[22] Filed: Dec. 10, 1971

[21] Appl. No.: 206,769

[52] U.S. Cl. ..... 264/78; 264/122; 264/162

[51] Int. Cl.[2] ..... D01F 1/04

[58] Field of Search ..... 264/122, 77, 73, 162, 264/112, 78

[56] References Cited

UNITED STATES PATENTS

| | | | |
|---|---|---|---|
| 2,066,734 | 1/1937 | Loetscher | 264/77 |
| 3,423,267 | 1/1969 | Munk | 264/112 |
| 3,492,388 | 1/1970 | Inglin et al. | 264/122 |
| 3,493,528 | 2/1970 | Rakszawski | 264/112 |

*Primary Examiner*—Robert F. White
*Assistant Examiner*—J. R. Hall
*Attorney, Agent, or Firm*—Ronald G. Bitner; James R. Hughes

[57] ABSTRACT

A method of making a decorative particleboard incorporating colored wood particles. The colored particles either make up the entire board or form a surface layer only. Some or all of the particles are colored one or more different colors. In other respects the method of manufacture may be similar to that of conventional particleboard. In the preferred form the particleboard is sanded to produce a marbleized surface pattern. A wide variety of effects are possible dependent on the size and shape of the particles, choice of colors, uniformity of coloring of individual particles, surface treatment, etc.

2 Claims, 3 Drawing Figures

METHOD OF MAKING COLORED PARTICLEBOARD

This invention relates to a method of making decorative colored particleboard.

Various types of decorative wood panels are known. A common type comprises a veneer of high quality wood backed, by a less expensive wood product. There are in use panels made entirely of particleboard but these have had little use as a decorative panel in their manufactured form.

In the manufacture of conventional particleboard wood particles are combined with a suitable adhesive and formed into a mattress. The mattress is hot-pressed at an elevated temperature and pressure and for time sufficient to provide the desired density and set the adhesive.

In accordance with the present invention the mattress includes colored particles. The method of making the decorative particleboard comprises essentially of coloring at least a portion of selected wood particles, drying all of the selected particles, forming a mattress from the selected particles with the colored particles included in at least a surface layer of at least one face of the mattress, and hot-pressing the mattress to compact and to set the adhesive and subsequently sanding the particleboard.

The particles forming the surface layers of the particleboard may be physically similar or distinct from those of the core.

This invention also envisages applying a layer of colored particles to a premanufactured particleboard.

The present invention provides a variety of decorative surfaces determined by the size and shape of particles, choice of colors, uniformity of coloring of individual particles, surface treatment, and the like. The decorative qualities form an integral part of the particleboard structure providing inherent advantages over a decorative surface coating.

Examples of colored particleboard in accordance with the present invention are shown in the accompanying drawings in which.

Figure 1:
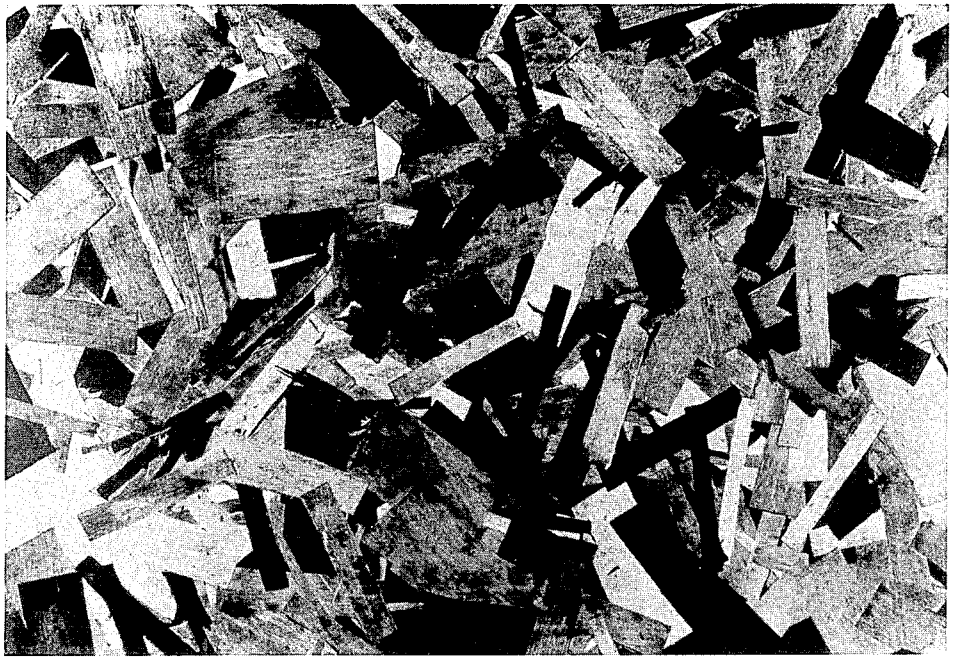
FIG. 1 is a photograph of the surface of colored particleboard without sanding.
Figure 2:
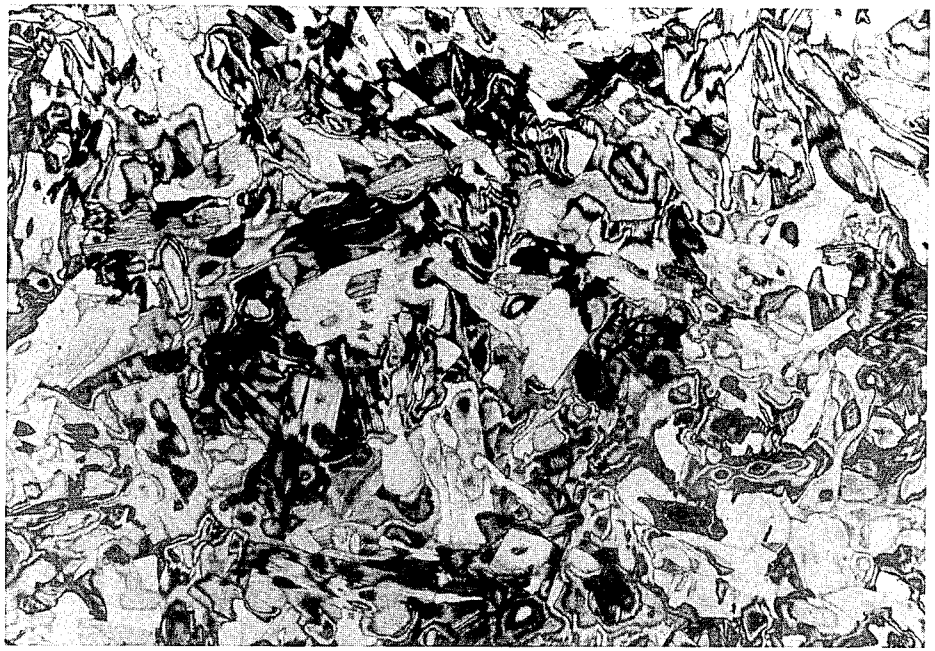
FIG. 2 is a photograph of the surface of particleboard of the type shown in FIG. 1 after sanding.

The colored particleboard of FIGS. 1 and 2 comprises wood flakes of three colors. The flakes of each color group were colored using a water soluble substantive dyestuff which colored the individual particles non-uniformly forming densely colored shells and lightly colored cores. The distribution of color is revealed by FIG. 2 where sanding has produced a marbleized surface pattern.

Figure 3:
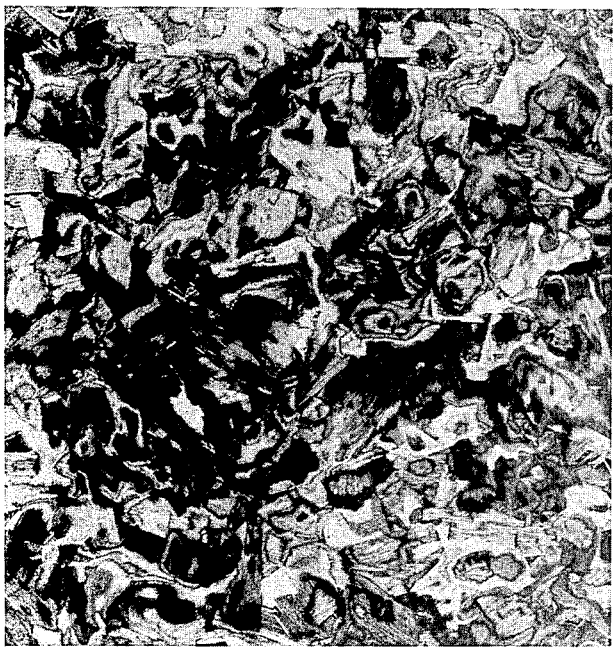
FIG. 3 is a photograph of the surface of another particleboard after sanding.

The colored particleboard of FIG. 3 incorporates chips of two colors. The dyebath used was formulated to provide substantially uniform coloring of the particles throughout. The sanded particleboard reveals a surface pattern having a lesser range of color intensity than that of FIG. 2.

Coloring of the wood particles may be effected in a number of ways. The preferred method utilizes a substantive dyestuff which absorbs onto the wood resulting in an intensely colored shell and lightly colored core. This non-uniform coloration of the particles contributes to the aesthetic characteristics of the particleboard when sanded. By special formulation of the dyebath a greater degree of color penetration with greater color uniformity can be achieved if desired. Other methods of coloring include vat dying and staining. The dyestuff chosen must have a reasonable resistance to light and gas fading. Specific compositions are detailed in the examples.

Following coloring, the particles are dried to obtain the desired moisture content. An adhesive binder is added to the particles and the mattress is formed. The adhesive binder may be in powder or liquid form providing it is compatible with the dyestuff. For economy only the surface layer of the finished particleboard need contain the colored particles. The type of particles may be similar throughout the thickness of the particleboard or alternatively the colored particles may form a layer on one or both sides. Moreover, a layer may be formed on a premanufactured board. It will be understood that it is desirable to have both sides of the particleboard structurally identical to minimize warping.

Forming and hot-pressing of the mattress are effected by methods which are known to those skilled in the art of particleboard manufacture.

After pressing, the particleboard is sanded. Sanding smoothes the surface eliminating voids and exposes regions of different shades of color to produce the distinctive marbleized surface. The depth of sanding will be determined largely by irregularity in the pressed board. It was found that large sheets tended to be thinner in the central region than around the perimeter. Hence the minimum depth of sanding will be that which produces a marbled pattern at the center consistant with that at the perimeter. Moreover, the minimum thickness of the surface layer of colored particles will be determined by the depth of sanding required.

A lacquer, oil or other clear coating may be applied to the surface. Such a coating intensifies the color and contrast of the sanded particleboard. Since the pattern is an integral part of the particleboard the surface can be readily renewed by resanding.

Specific methods of making colored particleboard are detailed in the following examples:

EXAMPLE 1.

6000 gms of freshly cut poplar flakes with an average thickness of 0.035 inches were added to a solution consisting of 42kg of water and an amount of a water soluble substantive dyestuff equal to ½% of the oven-dry weight of the wood. The mixture was then boiled for 30 minutes, during which time the dyestuff was adsorbed from the aqueous solution and adsorbed by the wood particles. The dyed particles were then dried to a moisture content of 15–20%. Coloring of the individual particles was non-uniform with a densely colored shell and a lightly colored core. A resin binder was then applied by blending the particles in a rotating drum blender with 3% of a finely divided powdered B-stage phenolic resin. The base of the panel was formed from smilar particles which were not dyed, and were dried to a moisture content of 6–10% and mixed with the same powdered resin adhesive binder. A particle mattress was formed by building up a layer of undyed particles amounting to 80% of the total weight of the mattress and the remaining 20% of the mattress weight was formed from the dyed wood particles. This mattress was pressed in a heated, hydraulic hot press at a pressure of 200 psi and a platen temperature of 340°F to compact the mattress to a density of 43 lbs/cu. ft and to cure the adhesive binder. The resulting particleboard, after cooling, was sanded to a depth of approximately one-half the thickness of the surface layer of dyed wood particles to develop an aesthetically pleasing marbled surface appearance.

EXAMPLE 2.

A board was made following the procedure in Example 1, except that the surface layer was composed of a mixture of particles which had been separately dyed three different colors using the dyeing procedure described in Example 1. The surface appearances before and after sanding were similar to that shown in FIGS. 1 and 2, respectively.

EXAMPLE 3.

6000 gms of green poplar flakes at a moisture content of 120%, and having an average thickness of 0.010 inch were placed in a rotating drum blender, and 5000ml of a solution of a non-substantive, water-soluble, blue dyestuff was sprayed onto the particles. The amount of dyestuff was 1 ½% of the oven dry weight of the wood particles. The sprayed wood particles were allowed to stand overnight in a sealed container to allow the dyestuff to diffuse throughout the thickness of the particles, and were then dried to a moisture content of 10%. The dried particles were then placed in the rotating drum blender, and a solution of liquid urea formaldehyde resin was applied to the particles by spraying. The amount of resin solids in the applied solution was 8% of the dry weight of the particles, and the solids content of the applied resin solution was 50%.

To obtain a composite effect, similar batches of wood flakes were treated in the manner just described, except that one batch was formed with a brown dyestuff and another was formed with a yellow dyestuff. Equal parts of the three batches of dyed and resin treated particles were mixed to obtain a material to be used as a surface layer on the finished board. For the base board, a mass of green poplar flakes was dried to 4% moisture content, and a 50% solution of urea-formaldehyde resin was applied to these by spraying in a rotating drum blender in an amount to give a proportion of resin binder solids equal to 8% of the dry weight of the wood particles. The finished board was obtained by forming the undyed particles into a mattress comprising 85% of the total weight of the board, and forming a surface layer comprising 15% of the total weight of the board from the mixture of flakes containing three colors. This mattress was hot pressed at a pressure of 200 psi and a platen temperature of 300°F to compact the mattress to a density of 45 lbs/cu ft and to cure the adhesive binder. The resulting panel, after cooling, was sanded to a depth of approximately ½ the depth of the compacted surface layer. The surface appearance was similar to that shown in FIG. 3.

EXAMPLE 4.

A mixture of colored wood particles prepared in the manner described in Example 1 was formed into a mattress on the surface of a premanufactured particleboard ⅝-inch thick. The thickness of the surface layer was such as to yield a surface layer approximately ⅛-inch thick after the composite had been hot pressed to compact the surface layer to a density of about 50 lb/cu ft and to cure the phenolic resin adhesive binder. The hot pressed composite, after cooling, was sanded to remove approximately one half the depth of the surface layer of colored particles. The surface appearance was similar to that of Example 1.

The invention is not to be limited by the previous examples. It will be apparent that a wide variety of surface patterns are possible depending on shape, size and orientation of particles, choice of colors, and surface treatment. Although flakes or chips are the preferred form of particle for the surface, any particles suitable for particleboard may be used. The particles in the surface layers of the particleboard may be physically different from those forming the core. For example, flakes may form the surface layers while relatively small particles make up the core. Low density woods are preferred since high density woods make it difficult to obtain a board surface free from voids.

A light colored wood is preferable for the particles which are to be colored since a wider range of coloring can be more readily obtained. An aesthetically pleasing effect may also be obtained by mixing colored particles with particles made from a wood which is naturally strong colored, such as walnut or ebony. Also, chips with different color uniformity may be mixed. The choice of color or the color combination will vary with the proposed use of the particleboard.

This invention is not to be limited to any particular use for the colored particleboard which may include wall paneling, floors, furniture and the like. The thickness, density and other variations in the colored particleboard discussed above will be determined by the intended use.

What is claimed is:

1. A method of making decorative colored particleboard comprising:

a. coloring wood flakes, having a thickness of from 0.01 to 0.035 inches, with a water soluble dyestuff such that the individual flakes are colored nonuniformly with a relatively densely colored surface and relatively lightly colored core;

b. mixing the wood flakes with an adhesive binder and forming a mattress therewith;

c. hot-pressing the mattress to compact said mattress and to set the adhesive binder thereby forming particleboard; and d. sanding a surface of the particleboard to provide a decorative marbled surface.

2. The method of claim 1 comprising wood flakes of at least two different colors.

* * * * *